US005992622A

United States Patent [19]

Blackemore

[11] Patent Number: 5,992,622

[45] Date of Patent: Nov. 30, 1999

[54] GOLF CLUB CASE

[76] Inventor: John Blackemore, 4 Norgetts La., Melbourn, United Kingdom, SG8 6HS

[21] Appl. No.: 08/988,568

[22] Filed: Dec. 11, 1997

[51] Int. Cl.[6] ..... A63B 55/00; A63B 55/06; A63B 55/08

[52] U.S. Cl. ..... 206/315.3; 206/315.4; 206/315.6; 206/315.7

[58] Field of Search ..... 206/315.2–315.8

[56] References Cited

U.S. PATENT DOCUMENTS

| | | | |
|---|---|---|---|
| D. 272,285 | 1/1984 | Gillett | 206/315.3 X |
| 1,570,500 | 1/1926 | Kennedy | 206/315.6 |
| 1,600,601 | 9/1926 | Sampson | 216/315.2 |
| 3,460,597 | 8/1969 | Daly | 206/315.4 |
| 3,707,279 | 12/1972 | Kaiser | 206/315.6 X |
| 3,941,398 | 3/1976 | Nelson | 206/315.6 X |
| 3,953,045 | 4/1976 | Feret, Jr. | 206/315.6 X |
| 4,012,051 | 3/1977 | Embinder | 206/315.4 X |
| 4,332,283 | 6/1982 | Rader | 206/315.6 |
| 4,522,299 | 6/1985 | Clark et al. | 206/315.6 X |
| 4,836,565 | 6/1989 | Catalo | 206/315.2 X |
| 4,905,827 | 3/1990 | Kim | 206/315.6 X |
| 5,050,730 | 9/1991 | Suberbielle | 206/315.5 X |
| 5,071,147 | 12/1991 | Stansbury | 206/315.6 X |
| 5,607,128 | 3/1997 | Suk | 206/315.7 X |
| 5,671,842 | 9/1997 | Jaworski | 206/315.6 X |
| 5,699,906 | 12/1997 | Lombardo et al. | 206/315.3 |

FOREIGN PATENT DOCUMENTS

| | | | |
|---|---|---|---|
| 1295246 | 11/1972 | United Kingdom | 206/315.2 |
| 9216266 | 10/1992 | WIPO | 206/315.3 |

*Primary Examiner*—Sue A. Weaver
*Attorney, Agent, or Firm*—Fildes & Outland, P.C.

[57] ABSTRACT

A golf club case comprises an elongate hollow housing with an access aperture in a wall thereof, the aperture being openable and closable by a lid. A support is located within the housing adjacent the access aperture and has a wall defining a plurality of holes adapted to receive therethrough the shafts of respective golf clubs. The holes may be extended by means of respective tubes lying in register therewith and extending at least partially within the interior of the case housing. For security purposes, the lid may be lockable to the housing.

18 Claims, 6 Drawing Sheets

GOLF CLUB CASE

FIELD OF THE INVENTION

The present invention relates to a case for storing and carrying golf clubs.

Throughout this specification, the term "golf club" is used to embrace any type of implement for striking a golf ball during a game of golf, such implements including drivers, irons and putters.

BACKGROUND AND PRIOR ART

Conventional golf bags for storing, carrying or otherwise transporting golf clubs generally comprise an elongate bag or other suitable container which has a closed base and an open top and in which a plurality of inverted golf clubs can be stored, usually with the major lengths of their shafts accommodated within the bag and with their playing heads protruding from the open top thereof. The golf clubs are so-stored in the golf bag in a random manner, which means that a golfer can experience some difficulty in readily locating a particular club during play.

Also, the material, such as a fabric, plastics, leather or synthetic leather material, from which known golf bags are made, is generally flimsy and can be easily torn or otherwise damaged and, when made of certain fabric materials, tends not to be sufficiently waterproof, such that during adverse weather conditions, the material tends to become water-logged and, hence, the golf clubs stored within the bag becomes damp or even wet.

Some known types of golf bag are provided with covers for location over the heads of the golf clubs stored within the bags, thereby closing the otherwise open tops of the bags, to provide some protection for the clubs. However, such covers are usually detachably secured to the golf club bags by means of press studs or are hingedly connected to the bags and retained in their closed positions by means of a zip arrangement. However, security against unauthorised removal of the golf clubs from such covered bags is minimal, in that the covers can be readily removed, to permit access to the clubs stored therein.

SUMMARY OF THE INVENTION

The presently-inventive golf club case sets out to eliminate, or at least substantially reduce, the disadvantages discussed above in relation to known types of golf club bag, whilst also ensuring dry golf clubs in the wettest of weather, the ability to locate readily a particular golf club during play, providing additional storage for golf clothing, such as, waterproofs, gloves and headwear, as well as golfing accessories, such as golf balls and tees, providing reliable security against theft of the stored golf clubs, and, yet further, durability and compactness.

Accordingly, the invention provides a golf club case comprising a generally elongate and hollow housing defining in an outer wall thereof an access aperture, a lid which is movable between open and closed positions with respect to the housing for opening and closing said access aperture, and a support which is located within the housing adjacent said access aperture and which has a wall defining a plurality of holes adapted to receive therethrough the shafts of respective golf clubs.

In the preferred embodiment of golf club case to be described hereinbelow, at least some of, but preferably all, the holes defined in the one wall of the support are provided with tubes having respective open ends thereof lying in register with said holes and extending downwardly within the interior of the outer housing, for locating the respective golf club shafts in proper position within the housing interior. Any such tubes may be rigidly or movably attached to the underside of said wall of the support.

Preferably, said wall of the support also defines a plurality of recesses, for example by means of spaced ribs upstanding therefrom, in which at least some of the holes are located at the bases thereof, such that the heads of the corresponding golf clubs whose shafts are received in said holes, can be nested within the recesses.

Preferably also, the support is in the form of a preformed member which is generally U-shaped or L-shaped in section and is located within and secured to the interior of the housing adjacent the access aperture thereof, such that one side of its section lies adjacent or against the inner surface of a rear wall of the housing and the other side of its section extends across substantially the width and depth of the housing between respective opposed pairs of side and rear and front walls thereof.

The housing is preferably made of a rigid material, such as a moulded plastics material, in which case, the lid of the case is also preferably made of the same rigid material from which the housing is made. Also, the lid may be locked to the housing when in its closed position with respect to the access aperture thereof. In an embodiment of golf club case to be described hereinbelow, the lid is mounted pivotally to the housing, such that it can be pivoted between its open and closed positions with respect to the access aperture in the housing outer wall.

Also, the housing may be provided with carrying handles, preferably on respective opposed side walls thereof.

Further, the housing may also be provided with a stand for supporting the case in an upright or semi-upright position. The stand may be secured, optionally detachably, to the rear wall of the housing, for example by means of a quick release fastening. The stand may also be collapsible into a folded down condition and, when secured to the housing rear wall, may be accommodated within a recess of suitable shape and dimensions in the housing rear wall, such that the so-accommodated, folded down stand is generally flush with that rear wall. Suitable means, preferably associated with the rear wall of the housing, may be provided for detachably mounting the case upon a trolley or other suitable transportation means. Additionally or alternatively, attachment means, such as clips or eyes, preferably mounted on the rear wall of the housing, may be provided, to which respective opposed ends of at least one carrying strap can be attached.

The housing may also be provided with compartments, preferably interior thereof, for storing clothing and/or golfing accessories.

In order that the inventive golf club case may be more fully understood, preferred embodiments in accordance therewith will now be described in more detail hereinbelow in conjunction with the accompanying drawings.

DETAILED DESCRIPTION OF THE PREFERRED EMBODIMENT

Figure 2:
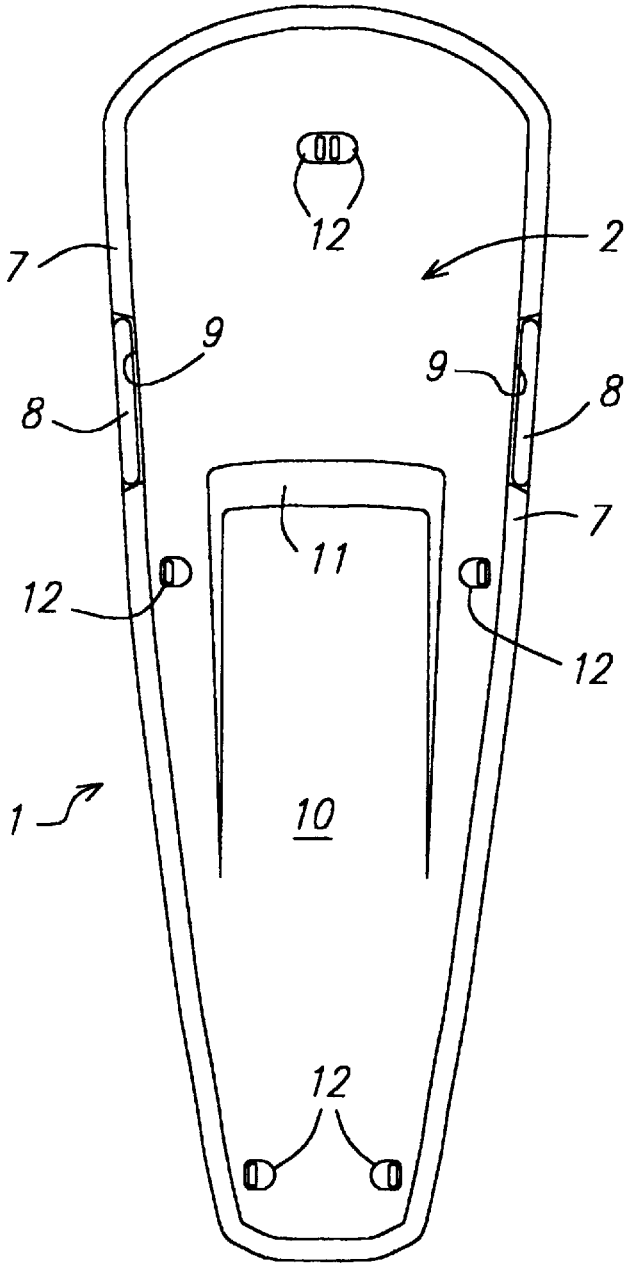
FIG. 2 is a rear elevational view of the embodiment of golf club case shown in FIG. 1.
Figure 1:
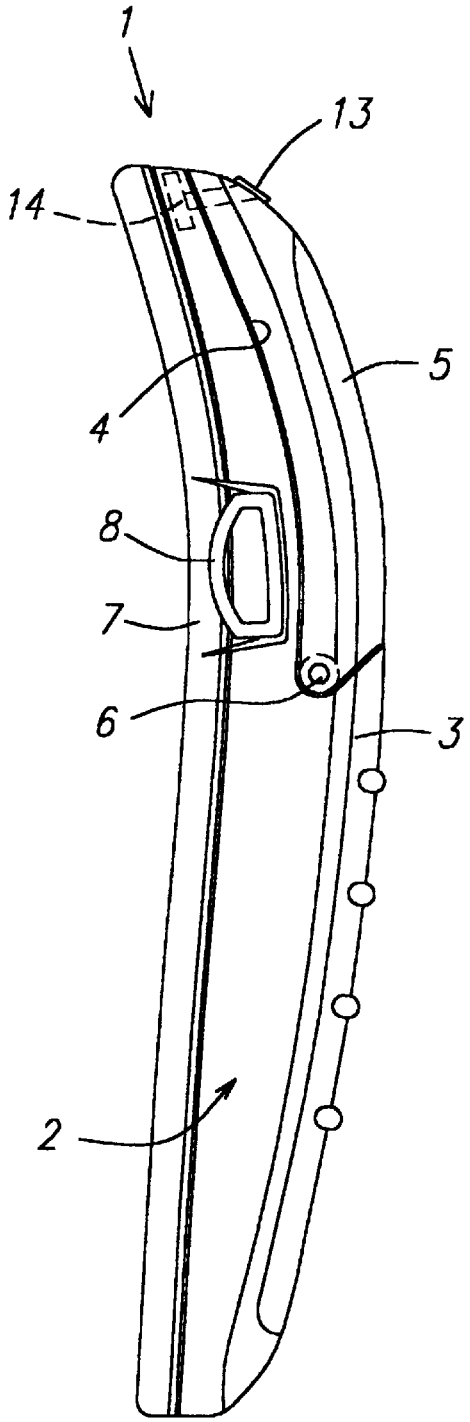
FIG. 1 is a side elevational view of a first embodiment of golf club case, with its lid in the closed position.

Referring firstly to FIG. 1 and 2 of the drawings, a first embodiment of a golf club storage case in accordance with the invention is indicated generally at 1 and comprises a generally elongate, hollow housing, indicated generally at 2 and defining in an outer front wall 3 thereof an aperture 4 for allowing access to the interior of the housing 2. A lid 5 is mounted pivotally at 6 to the housing 2 for movement between open and closed positions with respect thereto, for opening and closing the access aperture 4. The lid 5 has a lock 13 which is cooperable with a complementary latch 14 on the housing 2 for locking the lid 5 in its closed position with respect to the aperture 4.

Opposed side walls 7 of the housing 2 are provided with hinged carrying handles 8 which, when not in use, are located within corresponding recesses 9, such that they are generally flush with their respective housing side walls 7.

The rear wall 10 of the housing 2 is provided with a mount 11, for detachably mounting the case 1 upon a golf trolley or other suitable transportation means. Also, that rear housing wall 10 has a plurality of clips or eyes 12 to which can be attached respective ends of at least one carrying strap (not shown).

The housing 2 and lid 5 are made of a rigid material, such as a moulded plastics material, and are shaped and dimensioned to provide a streamlined profile for the case 1 when the lid 5 is in its closed position with respect to the access aperture 4, as shown in FIG. 1.

Figure 3:
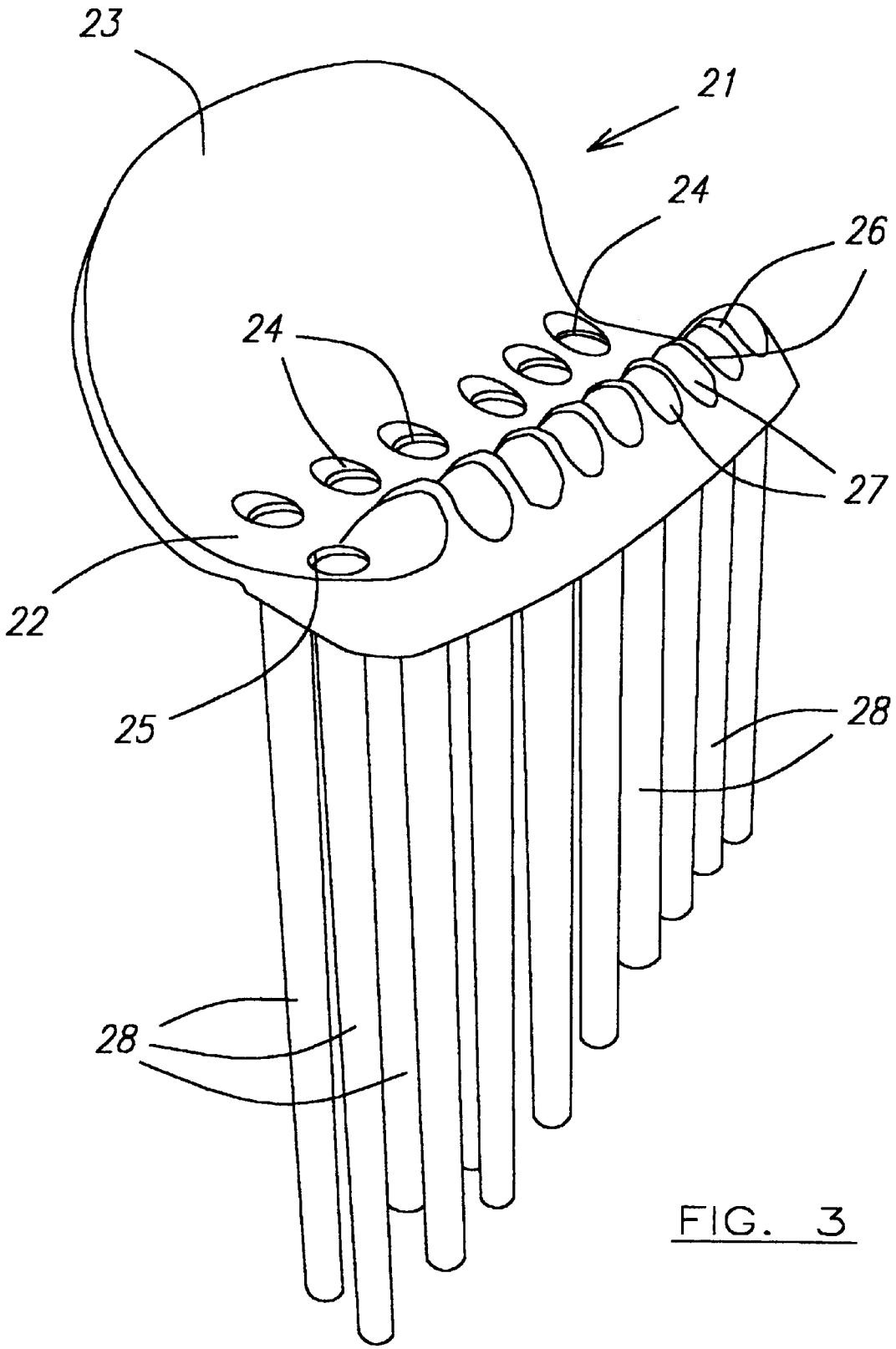
FIG. 3 is a perspective view of a golf club support used in the golf club case shown in FIGS. 1 and 2.
Figure 4:
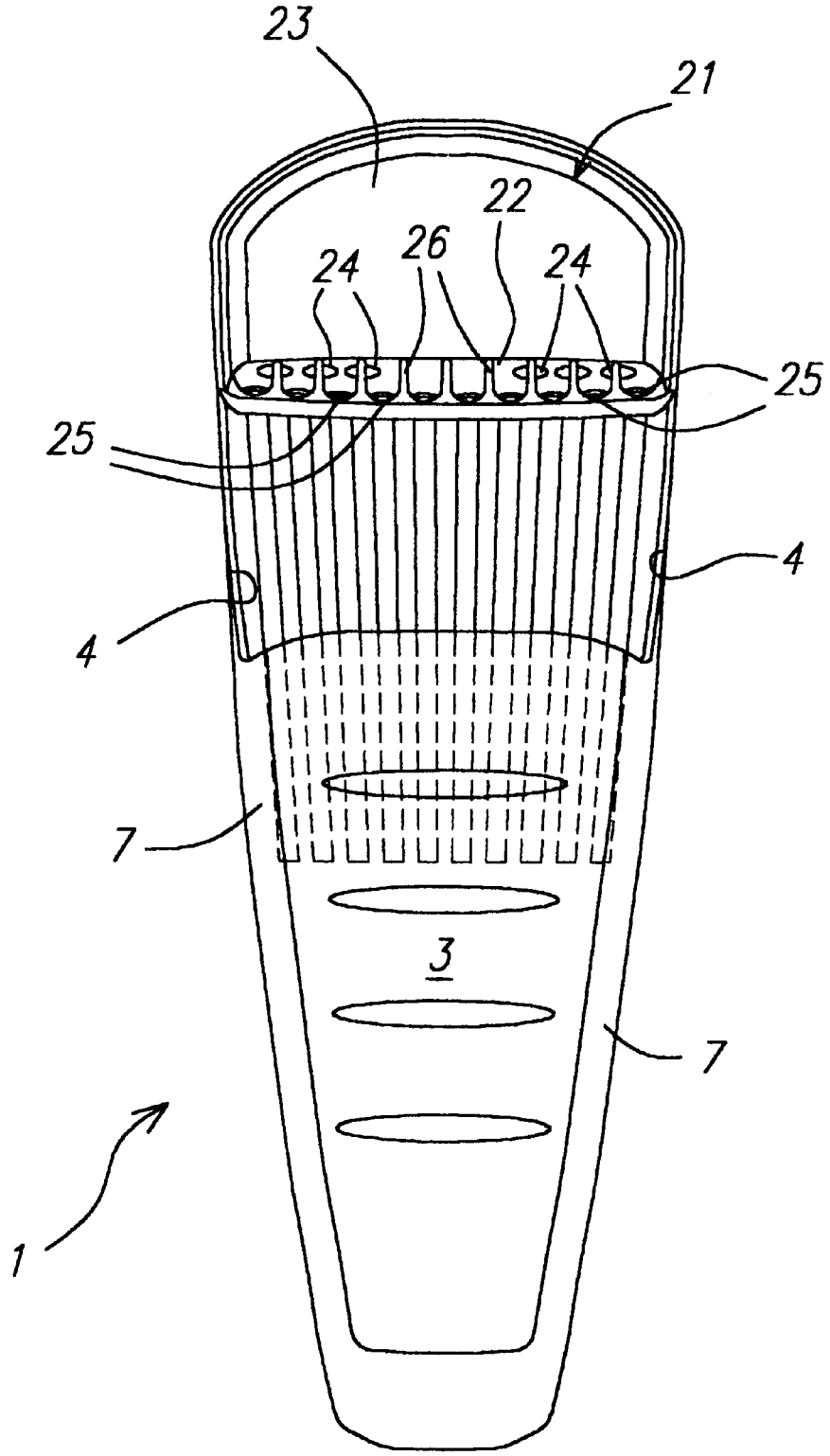
FIG. 4 is a front elevational view of the case shown in FIGS. 1 and 2 with the support of FIG. 3 located therein, but with the lid thereof omitted.

Referring now to FIGS. 3 and 4 of the drawings, secured within the housing 2, adjacent the top region of the access aperture 4, is a support in the form of a preformed member which is generally U-shaped in section, one side of the U defining a base wall 22, with the other side of the U defining a generally upright rear wall 23.

The support member 21 is secured within the housing 2, with its rear wall 23 in generally confronting relationship with the rear wall 10 of the housing 2.

Defined within the base wall 22 of the support member 21 is a plurality of holes of which six 24 constitute a rear row thereof and ten 25 constitute a front row thereof.

The base wall 22 of the support member 21 also has a plurality of spaced, upstanding ribs 26 which define between adjacent pairs thereof recesses 27 in whose bases respective holes 25 are located.

Associated with each hole 24, 25 in the base wall 22 of the support member 21, is a tube 28 whose upper end is attached to the underside of the base wall 22, such that its open end lies in registration with the corresponding hole 24, 25. These sixteen tubes 28, which are also open at their lower ends, extend downwardly within the interior of the housing 2, as shown in FIG. 4.

Because the side walls 7 of the housing 2 taper slightly inwardly, the outer ones of the tubes 28 are inclined slightly inwardly of the housing 2, such that they follow the interior profile of the side walls 7.

In use of the golf club case 1, as described above in relation to FIGS. 1 to 4, golf clubs of different types are stored therein with their shafts extending downwardly through the holes 24, 25 in the base wall 22 of the support member 21 and through respective tubes 28, with their heads located in juxtaposition with the base wall 22.

Smaller golf clubs, such as irons and putters, preferably have their shafts extending through the front row of holes 25 and respective tubes 28, such that the heads thereof are nested within the recesses 27 defined between corresponding adjacent pairs of upstanding ribs 26.

Larger clubs, such as woods or drivers, preferably have their shafts extending through the rear row of holes 24. The lengths of their shafts may be sufficiently long such that their heads are located above the base wall 22 of the support member 21, although such heads may rest against the rear wall 23 of that member 21. Alternatively, if their shafts are sufficiently short, then their corresponding heads may rest upon the base wall 22.

Figure 6:
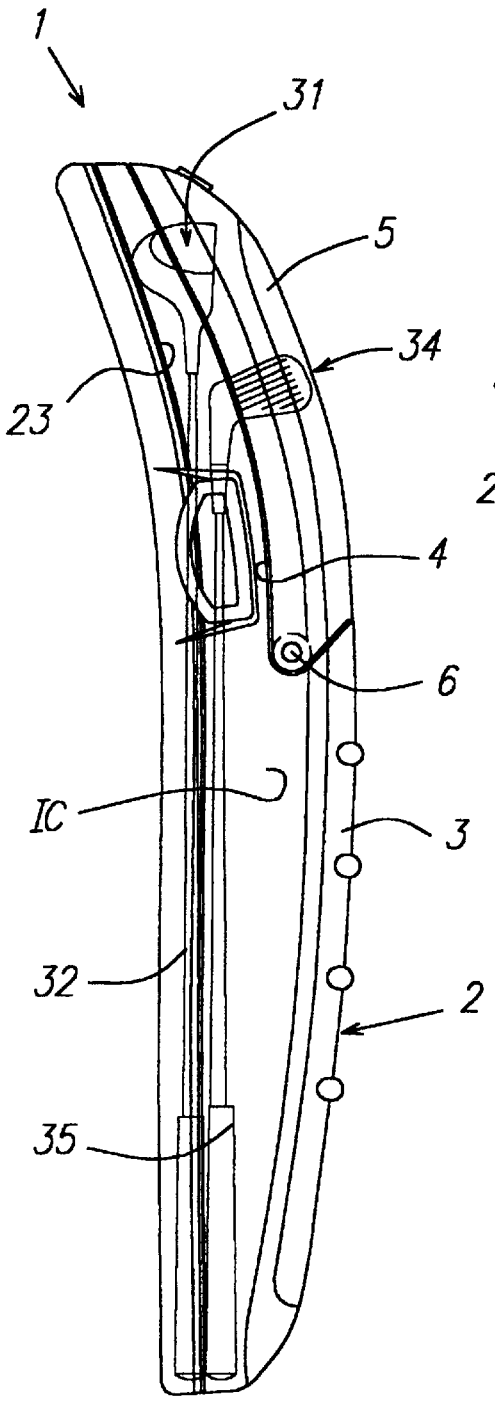
FIGS. 5 and 6 are respective front and side elevational views of the first embodiment of golf club case showing the disposition therein of a plurality of stored golf clubs, with certain components of the case removed, for reasons of clarity.
Figure 5:
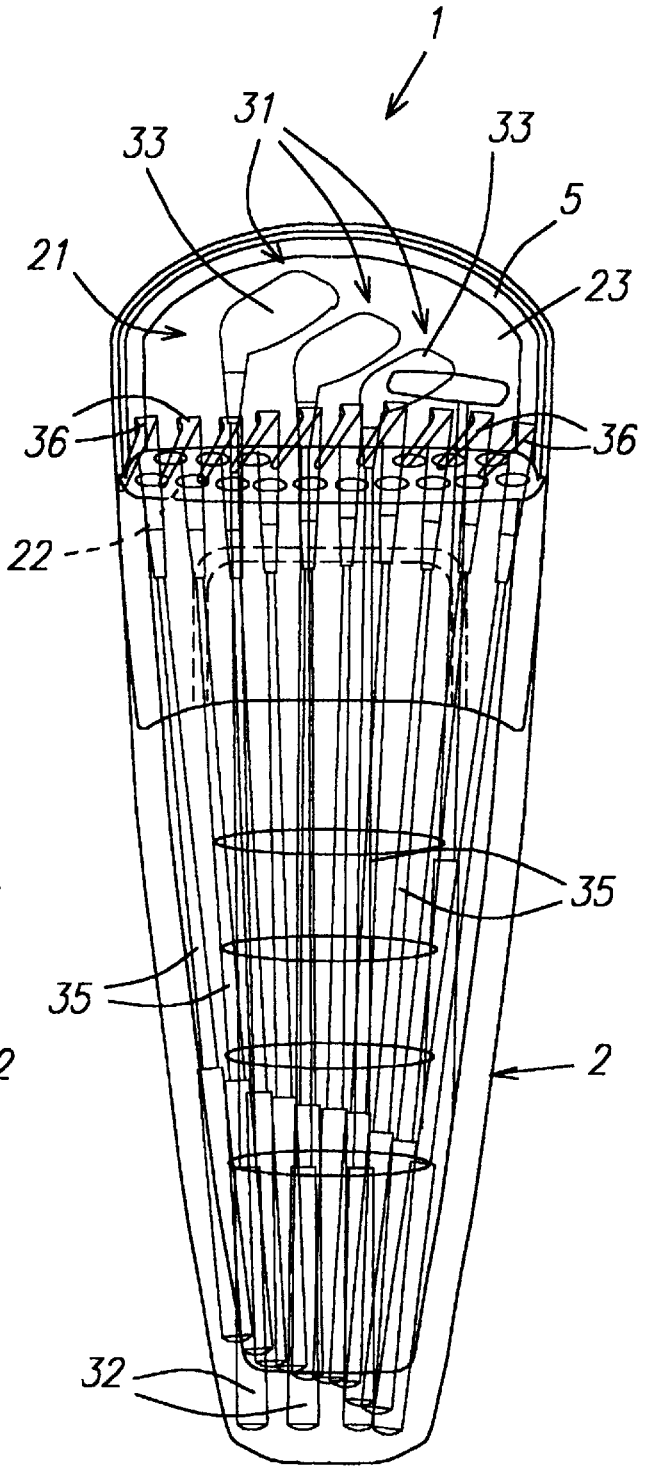

Such storage of the clubs within the case 1 is illustrated in FIGS. 5 and 6 but with the tubes 28 omitted, such that the positioning and orientation of the club shafts within the case 1 can be identified clearly.

In FIGS. 5 and 6, the case 1 is shown with the lid 5 in its closed position with respect to the access aperture 4 defined generally in the front wall 3 of the housing 2.

As illustrated in FIG. 6, case 1 is provided with a compartment IC, on the interior thereof for storing clothing and/or golfing accessories.

Three woods or irons 31 have their shafts extending through corresponding holes 24 of the rear row thereof and downwardly through the corresponding tubes 28, with their heads 33 located above the base wall 22 of the support member 21 but resting against the rear wall 23 thereof.

Ten smaller clubs 34, such as irons and drivers, have their shafts 35 extending through respective ones of the front row of holes 24 and through respective tubes 28, with their heads 36 nested in the recesses 27 defined between corresponding adjacent pairs of ribs 26.

During play, a suitable club can be selected for a particular shot by pivoting the lid 5 about 6, such that the lid 5 is moved into its open position with respect to the access aperture 4, thereby permitting access to the clubs 31, 32.

The clubs 31, 32 are stored neatly within the housing 2, such that a golfer can readily select the required club and, after play with that club, can replace it quite easily, for selection of another club for the next shot.

Figure 7:
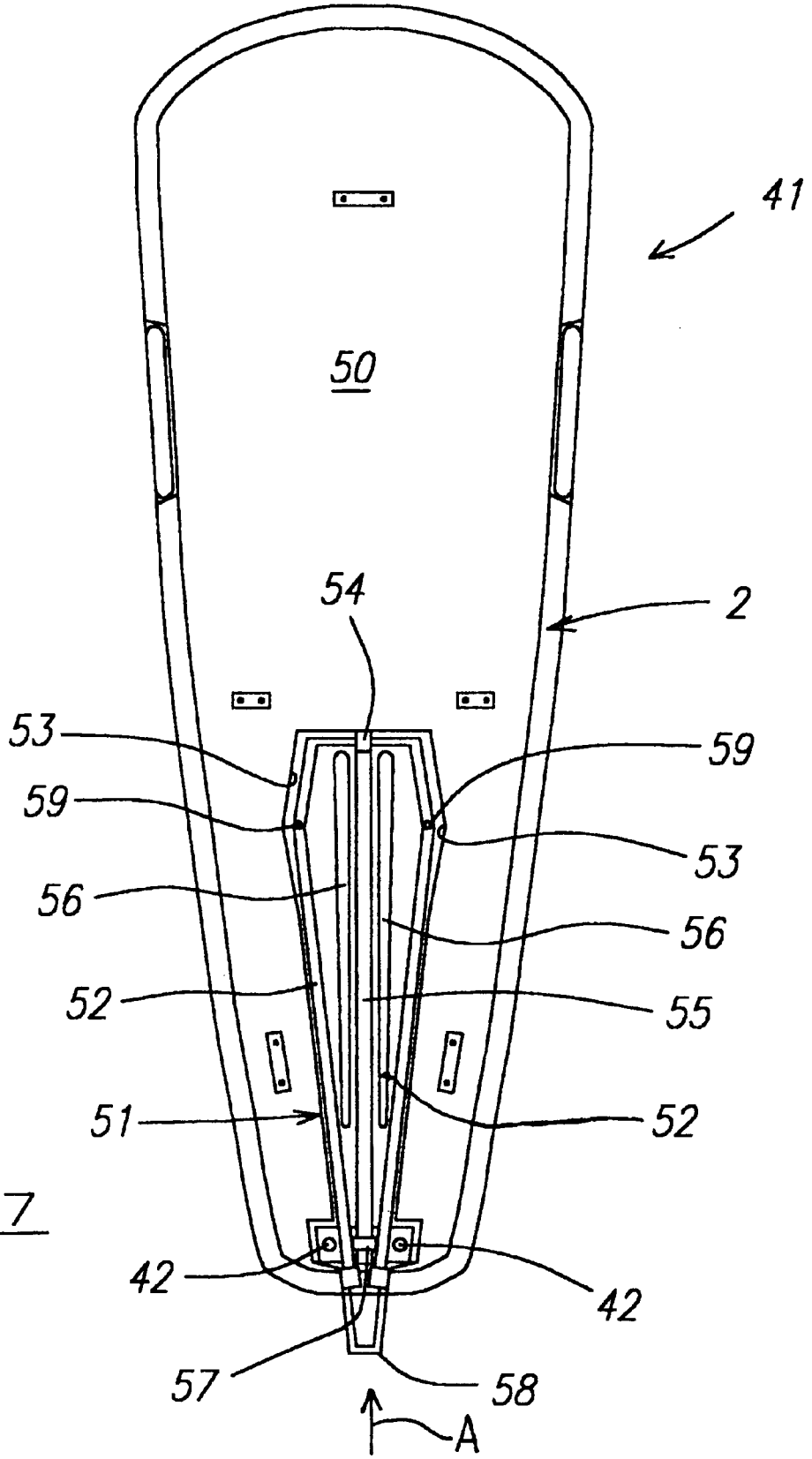
FIG. 7 is a rear elevational view of a second embodiment of golf club case with a stand collapsed into its folded down condition.
Figure 8:
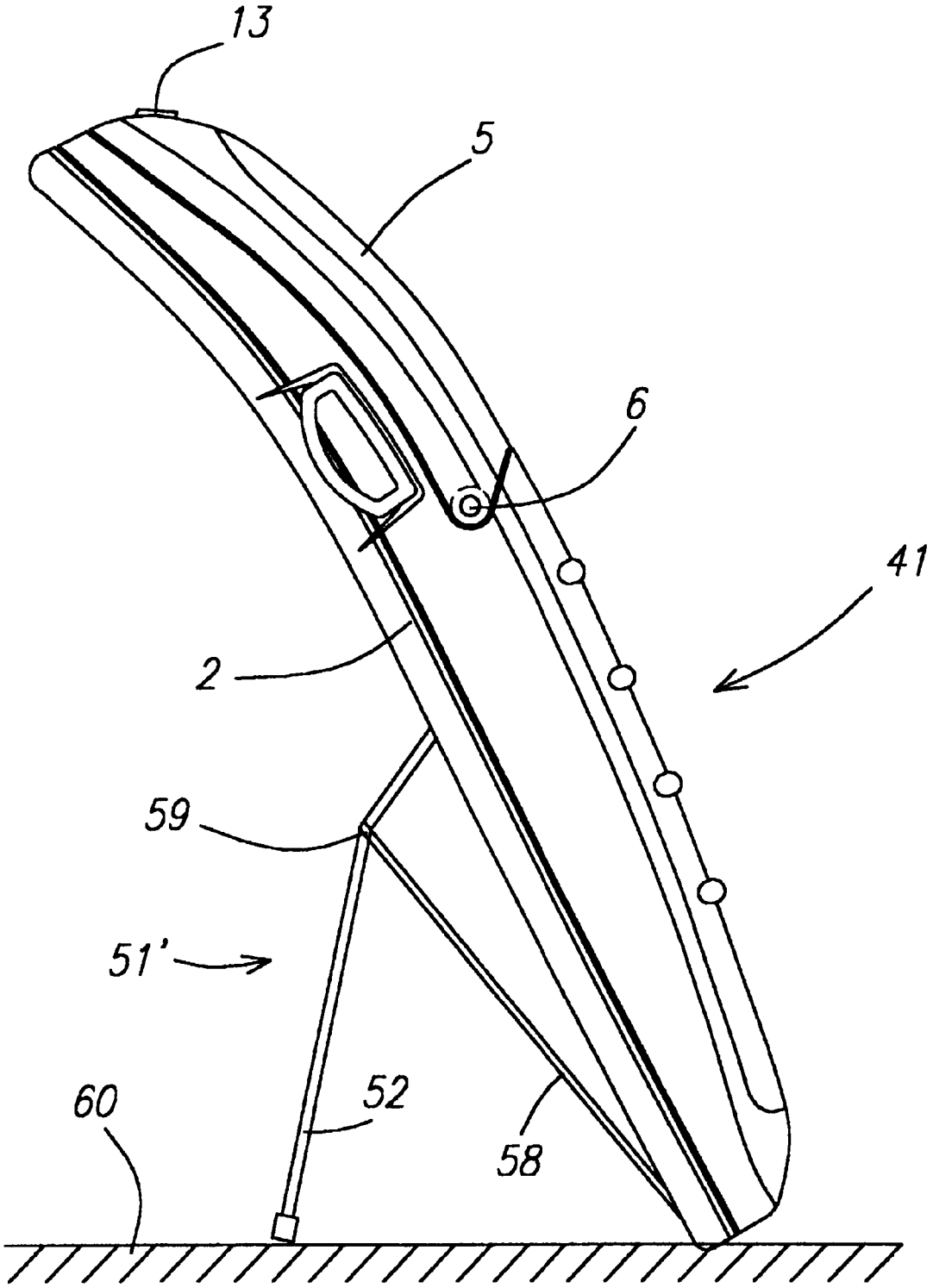
FIG. 8 is a side elevational view of the second embodiment of golf club case shown in FIG. 7 but with its stand in an extended condition.

In FIGS. 7 and 8, there is shown a second embodiment of golf club case indicated generally at 41, which includes the major components, namely, the rigid plastics housing 2, lid 5 and support member 21 (not shown) of the first embodiment of golf club case described above. However, the rear of the case 41 has been modified to include a stand indicated generally at 51, which is detachably secured to the rear wall 50 of the housing 2 by means of a quick-release mechanism 42.

In FIG. 7, the stand 51 is shown in its collapsed, folded-down condition, with two legs 52 thereof accommodated generally within a suitably shaped recess 53 defined in the rear wall 50 of the housing 2. The two legs 52 are pivoted at 54 to a third leg 55 which is also accommodated within the recess 53 between a pair of parallel-spaced, elongate ribs 56 upstanding from the base of the recess 53. The third leg 55 is retained in generally parallel relationship with respect to the rear wall 50 of the housing 2 by means of a retaining bar 57 attached to the stand release mechanism 42. A generally U-shaped operating rod 58, for moving the two legs 52 between their respective folded-down and extended conditions, is pivotally attached at each end thereof to the two legs 52.

In FIG. 8, the stand 51' is shown with the two legs 52 in their extended conditions, thereby supporting the golf club case 41 in a semi-upright position upon a surface 60. In this extended condition of the two legs 52, the operating rod 58 has been moved in the direction of the arrow A in FIG. 7, such that the legs 52 are pivoted at 59 with respect to the rod 58 and also at 54 with respect to the third leg 55. This operation is reversed to collapse the stand 51 such that the two legs 52 are returned to their folded-down condition, as shown in FIG. 7.

Again, the lid 5 of the housing 2 is provided with a lock 13 for locking the lid 5 in its closed position with respect to the housing 2.

Otherwise, the second embodiment of case 41 of FIGS. 7 and 8 is substantially identical to the first embodiment of case 1 described above in relation to FIGS. 1 and 6.

I claim:

1. A golf club case for housing a plurality of golf clubs, said golf club case comprising:

an elongate rear wall having upper and lower sections connected by a portion of arcuate shape;

a side wall extending around the periphery of said elongate rear wall on a convex side thereof;

a front wall opposed to said elongate rear wall and having an arcuate shape generally corresponding to the profile of said elongate rear wall;

said front wall extending from said side wall and having an access aperture in an upper end opposed to said upper section of said elongate rear wall;

a lid mountable to said side wall for opening and closing said access aperture in said front wall; and a support disposed within a housing defined by said rear, side and front walls adjacent said access aperture, said support including a plurality of holes adapted to receive therethrough the shafts of said plurality of golf clubs.

2. A golf club case as in claim 1 wherein said case is made of rigid material.

3. A golf club case as in claim 2 wherein said rigid material is molded plastics.

4. A golf club case as in claim 1 including a plurality of tubes in registration with said holes in said support and extending downwardly between said lower section and front wall for locating respective golf club shafts within said case.

5. A golf club case as in claim 1 wherein said support includes at least one recess around one of said holes for nesting a head of a golf club in said recess.

6. A golf club case as in claim 1 wherein said support is defined by a generally L-shaped section.

7. A golf club case as in claim 1 wherein said lid is pivotally mounted to said side wall.

8. A golf club case as in claim 1 including a carrying handle mounted to said side wall.

9. A golf club case as in claim 1 including a mount for detachably mounting the golf club case on a golf trolley.

10. A golf club case as in claim 1 including attachment means mounted on the elongate rear wall, to which opposed ends of a carrying strap can be attached.

11. A golf club case as in claim 1 including compartments on the interior thereof, for storing accessories.

12. A golf club case as in claim 1 including a stand for supporting the golf club case in an upright position.

13. A golf club case as in claim 12 wherein said stand is secured to the rear wall.

14. A golf club case as in claim 13 wherein said stand is detachably secured to the rear wall.

15. A golf club case as in claim 12 wherein said stand is foldable between respective folded-down and extended positions.

16. A golf club case as in claim 1 wherein said rear wall includes a recess for accommodating said stand in its folded-down position.

17. A golf club case as in claim 1 wherein said rear wall is wider at its upper end than its lower end.

18. A golf club case as in claim 17 wherein said side wall has a height less than the width of said rear wall.

* * * * *